US009476427B2

(12) United States Patent
Torkildsen et al.

(10) Patent No.: US 9,476,427 B2
(45) Date of Patent: Oct. 25, 2016

(54) CONTRA ROTATING WET GAS COMPRESSOR

(71) Applicant: FRAMO ENGINEERING AS, Sandsli Bergen (NO)

(72) Inventors: Bernt Helge Torkildsen, Sandsli Bergen (NO); Per Gunnar Vikre, Sandsli Bergen (NO); Hans Frederik Kjellnes, Sandsli Bergen (NO)

(73) Assignee: FRAMO ENGINEERING AS, Sandsli Bergen (NO)

( * ) Notice: Subject to any disclaimer, the term of this patent is extended or adjusted under 35 U.S.C. 154(b) by 904 days.

(21) Appl. No.: 13/688,155

(22) Filed: Nov. 28, 2012

(65) Prior Publication Data

US 2014/0147243 A1 May 29, 2014

(51) Int. Cl.

| | |
|---|---|
| ***F04D 19/00*** | (2006.01) |
| ***F04D 19/02*** | (2006.01) |
| ***B63B 27/30*** | (2006.01) |
| ***F04D 25/06*** | (2006.01) |

(52) U.S. Cl.

CPC ..... *F04D 19/024* (2013.01); *B63B 27/30* (2013.01); *F04D 25/0686* (2013.01)

(58) Field of Classification Search

CPC .. F04D 19/024; F04D 25/0686; B63B 27/30

See application file for complete search history.

(56) References Cited

U.S. PATENT DOCUMENTS

| | | | | |
|---|---|---|---|---|
| 2,234,733 | A * | 3/1941 | Jendrassik | F04D 19/024 415/65 |
| 2,406,959 | A * | 9/1946 | Millard | F04D 13/10 310/115 |
| 4,830,584 | A * | 5/1989 | Mohn | F04D 17/025 415/143 |
| 2008/0267716 | A1 * | 10/2008 | D'Souza et al. | B63B 35/44 405/203 |

* cited by examiner

*Primary Examiner* — Richard Edgar
*Assistant Examiner* — Eldon Brockman
(74) *Attorney, Agent, or Firm* — Conley Rose, P.C.

(57) ABSTRACT

A counter-rotating wet gas compressor for deployment and operation on the sea floor is described. The compressor has alternating rows of impellers, with each successive row of impellers being mounted a central hub or to an outer sleeve. According to some embodiments, no static diffusers are positioned between the alternating counter-rotating rows of impellers such that the design is structurally robust, compact and capable of compressing fluids that contain significant portions of liquid phase.

20 Claims, 10 Drawing Sheets

CONTRA ROTATING WET GAS COMPRESSOR

BACKGROUND

Conventional turbo compressors known in the art are designed to compress a gas. They are normally composed of many stages (rotating impellers and static diffusers) stacked on a flexible shaft rotating at relative high speed. Critical mechanical elements such as bearings and thrust balancing devices are often exposed to the process fluid.

Any impurities in the process fluid such as solids or liquid are detrimental to both the thermodynamic and mechanical performance. When impurities or liquid are expected to be present in the process stream different types of auxiliary equipment are utilized to clean or dry the process gas upstream the compressor. Typically a gas scrubber and/or heat exchangers may be used to remove liquid from the process fluid.

Known attempts to modify conventional turbo compressors to be so called "liquid tolerant" have had very limited success and only very low liquid fractions can be accepted in some rear cases. However, even in these cases the presence of liquid will cause deterioration in the thermodynamic and mechanical performance.

The challenges are even greater when designing a gas compressor for use in a subsea environment. In particular, the robustness of the design and physical dimensions of the compressor should be considered when the compressor is to be deployed in subsea environments with challenging weather conditions. For example in the arctic, where there are significant oil- and gas resources, subsea deployment techniques such as via a ship's moon pool are of great benefit due to the presence of moving ice.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to some embodiments, a subsea deployable counter-rotating compressor for compressing a fluid is described. The compressor includes: a first elongated member rotatable about a longitudinal axis; a first plurality of impellers fixedly mounted to the first member and being shaped and arranged so as to exert force on the fluid in a direction primarily parallel to the longitudinal axis when the first member is rotated in a first rotational direction about the longitudinal axis; a second elongated member rotatable about the longitudinal axis; a second plurality of impellers fixedly mounted the second member such that the first plurality of impellers is interleaved with the second plurality of impellers, the second plurality of impellers being shaped and arranged so as to exert force on the fluid in the same direction as the first impellers when the second member is rotated in a second rotational direction about the longitudinal axis, the second rotational direction being an opposite rotational direction to the first rotational direction; and a motor system mechanically engaged to the first member so as to rotate the first member in the first rotational direction, and mechanically engaged to the second member so as to rotate the second member in the second rotational direction.

According to some embodiments the first elongated member is a hub and second elongated member is a sleeve that surrounds at least a portion of the hub. The first and second pluralities of impellers can be arranged in a plurality of rows of first impellers and a plurality of rows of second impellers, respectively, with the first and second rows of impellers being mounted on the hub and sleeve in an alternating pattern of rows with each row of impellers making up a stage of the compressor that counter rotates with respect to each adjacent stage. Fluid passing through the compressor during operation can include gas and liquid phases and are at substantially mixed by the counter rotation of the stages.

According to some embodiments, no static diffuser elements are positioned between the alternating rows of impellers, and the impellers are mounted directly to the hub and sleeve without any intermediate structural members. According to some embodiments, the motor system includes a first motor for rotating the first member in the first rotational direction and a second motor for rotating the second member in the second rotational direction. According to some embodiments, the compressor is dimensioned such that it can be deployed from a moon pool of a ship.

According to some embodiments, a method for compressing a fluid including a gas and liquid phases is described using a counter-rotating compressor on a sea floor. The method includes: rotating a first elongated member about a longitudinal axis in first rotational direction, the first elongated member having a plurality of first rows of impellers mounted thereon; rotating a second elongated member about a longitudinal axis in a second rotational direction, the second rotational direction being an opposite rotational direction to the first rotational direction, the second elongated member having a plurality of second rows of impellers mounted thereon; and sucking the fluid successively and alternatingly through the first and second rows impellers, with each row of impellers exerting force on the fluid in a direction primarily parallel to the longitudinal axis.

According so some embodiments a method for positioning a fluid compressor on a sea floor is described. The method includes: deploying a ship having a moon pool opening for installing subsea equipment to the sea floor; and lowering a compact turbo fluid compressor from the moon pool opening to the sea floor, the turbo fluid compressor being dimensioned so as to be deployable through the moon pool opening and being mechanically robust so as to reliably compress subsea fluids containing a mixture of gas and liquid phases.

BRIEF DESCRIPTION OF THE DRAWINGS

The subject disclosure is further described in the detailed description which follows, in reference to the noted plurality of drawings by way of non-limiting examples of embodiments of the subject disclosure, in which like reference numerals represent similar parts throughout the several views of the drawings, and wherein.

DETAILED DESCRIPTION

Figure 1:
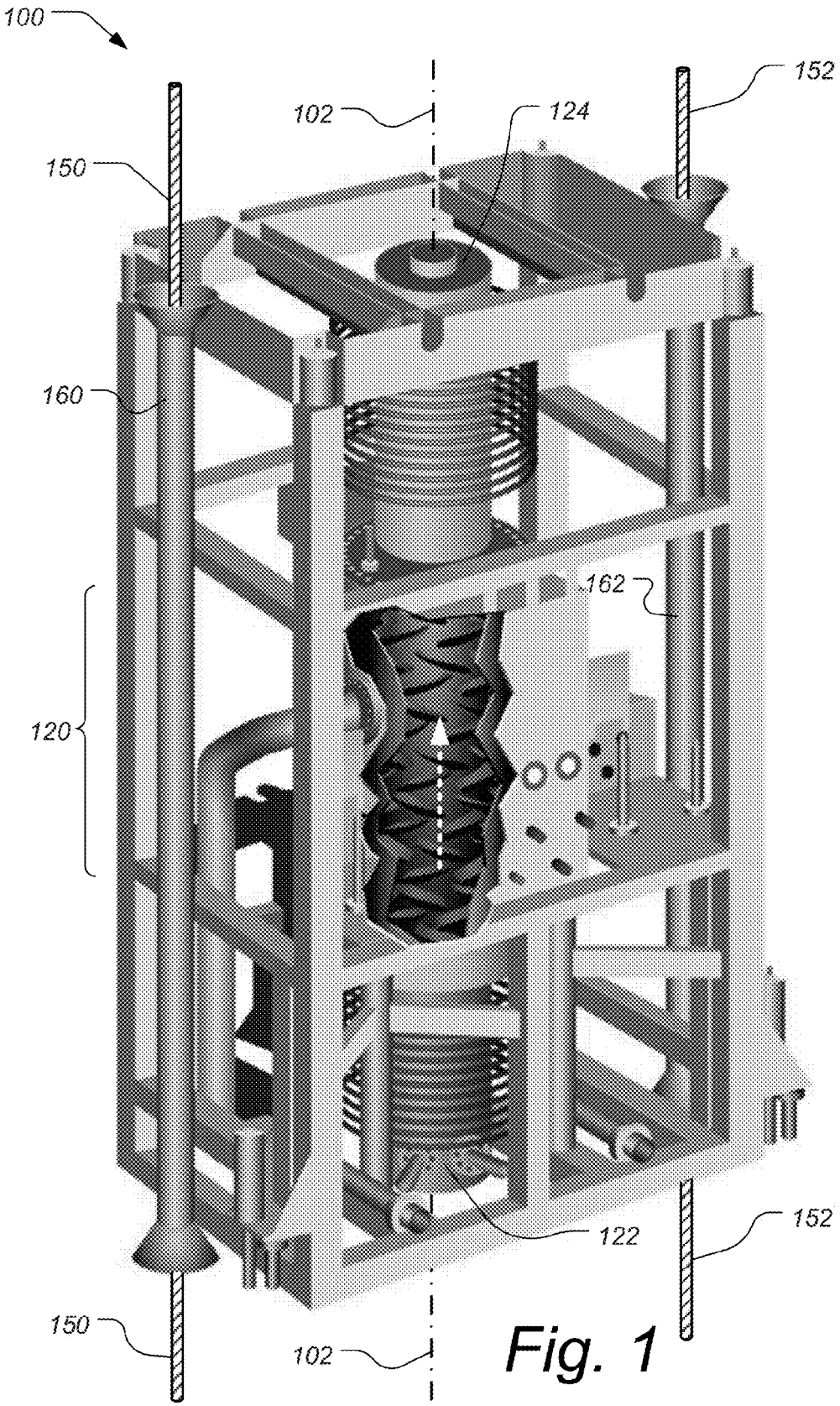
FIG. 1 is a diagram illustrating a contra rotating axial turbo compressor, according to some embodiments.

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details of the subject disclosure in more detail than is necessary for the fundamental understanding of the subject disclosure, the description taken with the drawings making apparent to those skilled in the art how the several forms of the subject disclosure may be embodied in practice. Further, like reference numbers and designations in the various drawings indicate like elements.

It has been found that in conventional dry gas compressors the presence of liquid in the process stream will cause significant deterioration in the thermodynamic and mechanical performance of the compressor. A main reason for this is that the gas and liquid tends to separate, and that compressors with static diffusers tend to have poor performance with separated gas and liquid phases. Furthermore, it has been found that many conventional dry gas compressors designs will actually induce separation in gas-liquid flows. When even small amounts of liquid separates from the main gas, the gas streamlines are disturbed and performance deteriorates. Boundary layer separation can occur and form local re-circulation zones and liquid concentration areas with large thermal gradients. Phase separation and boundary layer separation are two different phenomena which have been found to influence each other and both have negative effect on both the thermodynamic and mechanical performance of the compressor. Liquid concentration in particular can cause large dynamic and transient imbalances which can be detrimental for the mechanical performance of the compressor.

The operating envelope of a conventional turbo compressor is bounded by a "surge line" at low flow rates and by a "stone wall" at high flow rates. For flow rates lower than the "surge line" boundary layer separation occurs and causes performance degradation to such a degree that the compressor cannot operate. For flow rates higher than the "stone wall" choking occurs as the local velocity reach the sonic velocity and the flow rate cannot be increased further. It has been found that the presence of liquid and the effects thereof as described above will move the "surge line" to a higher flow rate and further limit the operating envelope. Additionally, the sonic velocity in a gas-liquid stream may be significantly lower than the sonic velocity in the single-phase gas and single-phase liquid stream. The presence of liquid will therefore move the "stone wall" to a lower flow rate and further limit the operating envelope. It has been found that the phenomena described above affecting the "surge line" and the "stone wall" are very complex and influenced by a large number of variable and transient parameters. These limits can therefore in general not be considered fixed for a compressor operating on a gas-liquid stream.

FIG. 1 is a diagram illustrating a contra rotating axial turbo compressor, according to some embodiments. The contra rotating compressor assembly 100 is designed especially for multiphase, gas-liquid and wet gas duties. Furthermore, the compressor assembly 100 is designed for deployment in a subsea environment, such as through an open moon pool on a ship. The compressor assembly 100 is shown being deployed via two guide cables 150 and 152 passing through guide tubes 160 and 162 respectively. The compressor assembly 100 includes two concentric shafts, both rotatable about central axis 102, with respective internal and external blades. A lower, inner shaft is driven by a lower motor 122 is attached to an inner hub that has blades or impellers mounted and arranged on an exterior of the hub within compressor section 120 so as to urge fluid in the compressor upwards (as shown by the dotted white arrow), when rotated in one direction about axis 102. An upper, outer shaft is driven by an upper motor 124 and has blades or impellers mounted and arranged such in an inner surface of a sleeve within compressor section 120 so as to urge fluid in the compressor upwards (also as shown by the dotted white arrow), when rotating in a direction about axis 102 that is opposite to the rotation of the lower shaft. The impellers mounted to the inner hub and outer sleeve are arranged so as to intermesh, through alternating stages or rows of impellers, with each two adjacent rows of impellers rotating in opposite directions.

Figure 2A:
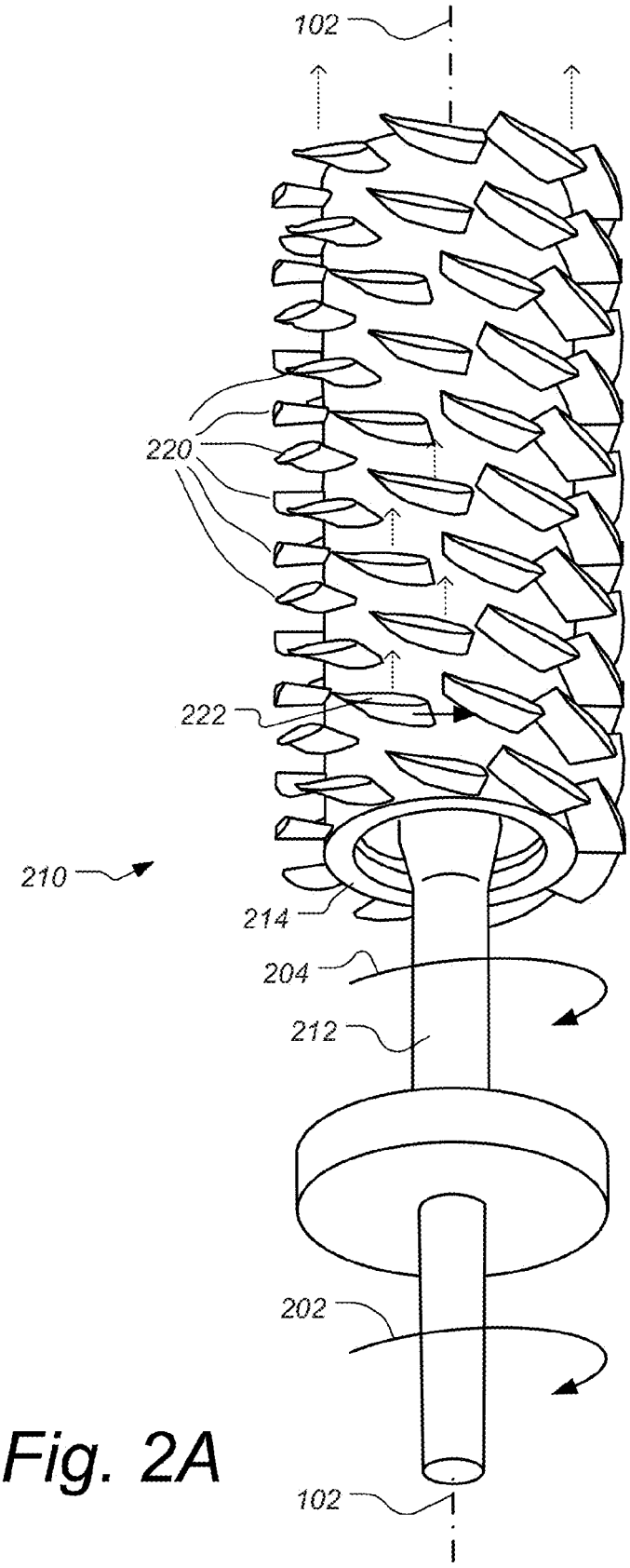
FIGS. 2A-2B show further details of an inner hub and outer sleeve assemblies with impellers forming part of a wet gas compressor, according to some embodiments.
Figure 2B:
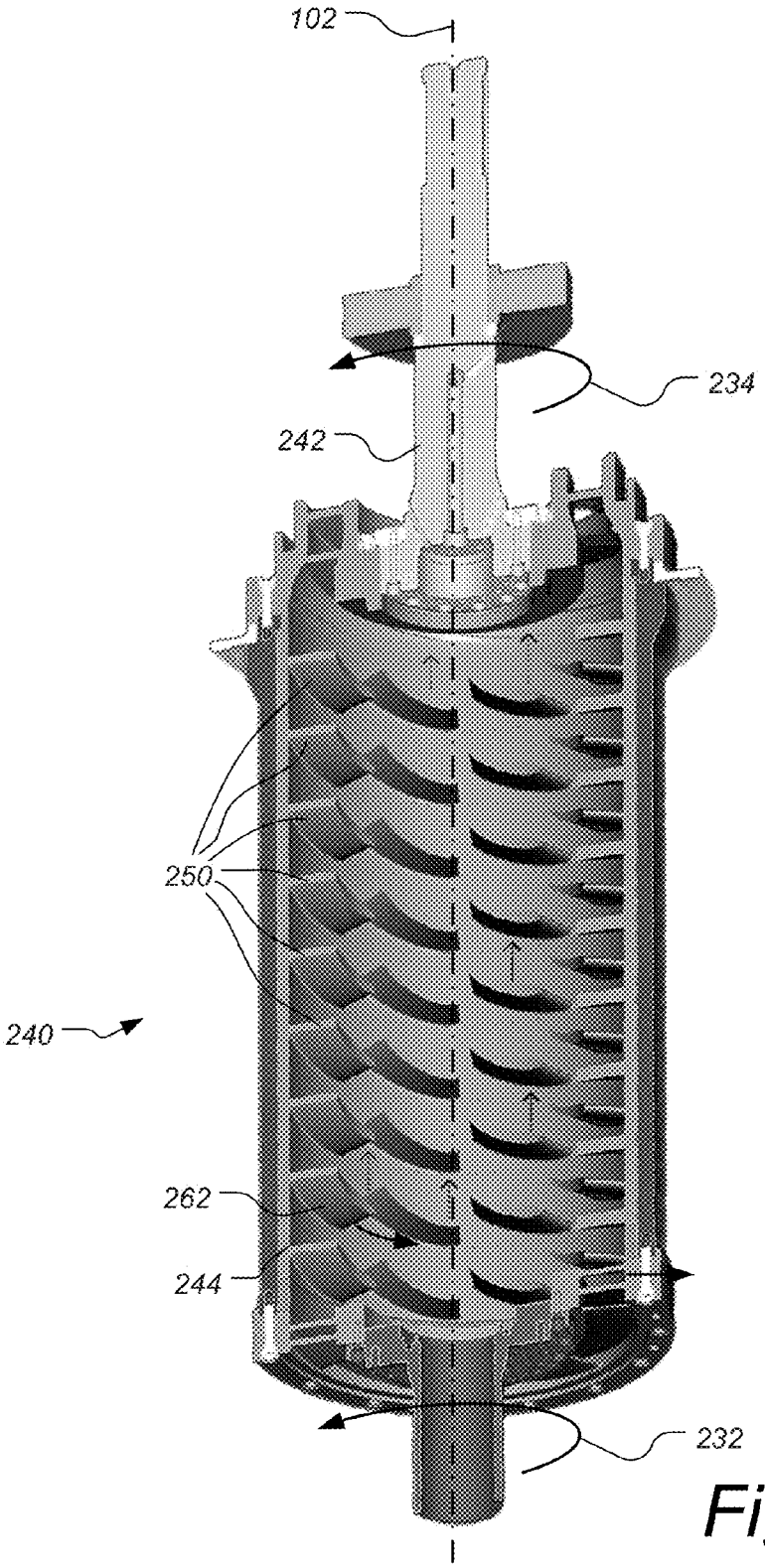

FIGS. 2A-2B show further details of an inner hub and outer sleeve assemblies with impellers forming part of a wet gas compressor, according to some embodiments. FIG. 2A is a perspective view of inner hub assembly 210 that includes a lower shaft 212 that is driven by motor 122 (shown in FIG. 1) about central axis 102 in the direction shown by the solid arrows 202 and 204. The shaft 212 is fixedly attached to inner hub 214 that has a cylindrical outer surface on which a plurality of impellers 220 are mounted and arranged. In particular, the impellers 220 are arranged in distinct rows. In the embodiment shown, there are 10 rows of impellers with each row having 9 impellers being mounted at the same longitudinal position with respect to the central axis 102. According to other embodiments, other numbers of impellers per row and numbers of rows can be used depending on various design considerations including for example anticipated fluid composition, dimensions, rotational speeds and materials used. The rows of impellers are separated longitudinally from each other row of impellers such that a row or impellers, not shown, mounted to the outer sleeve (shown in FIG. 2B) can be interleaved. Each of the impellers 220 is shaped so as to urge fluid in the compressor in an upward, longitudinal or axial direction (that is, in a direction parallel to the longitudinal axis of rotation 102 of the compressor). For example, when shaft 212 and hub 214 are driven in the direction shown by arrow 204, the impeller 222 is moves in the direction shown by the solid arrow and is shaped so as to urge fluid in an upward direction as shown by the dotted arrow.

FIG. 2B is a perspective view of outer sleeve assembly 240 that includes an upper shaft 242 that is driven by motor 124 (shown in FIG. 1) about central axis 102 in the direction shown by the solid arrows 232 and 234. Note that the direction of rotation of the outer sleeve 240 is in the opposite direction to the direction of rotation of the inner hub 210. The shaft 242 is fixedly attached to outer sleeve 244 that has a cylindrical inner surface on which a plurality of impellers 250 are mounted and arranged. As in the case of impellers 220 shown in FIG. 2A, the impellers 250 are arranged in distinct rows. In the embodiment shown, there are 9 rows of impellers with each row having 9 impellers being mounted at the same longitudinal position with respect to the central axis 102. According to other embodiments, other numbers of impellers per row and numbers of rows can be used. The rows of impellers are separated longitudinally from each other row of impellers such that a row or impellers, not shown, mounted to the inner hub (shown in FIG. 2A) can be interleaved. Each of the impellers 250 is shaped so as to urge fluid in the compressor in an upward, longitudinal or axial direction (that is, in a direction parallel to the longitudinal axis of rotation 102 of the compressor). For example, when shaft 242 and hub 244 are driven in the direction shown by arrows 232 and 234, the impeller 262 is moves in the direction shown by the solid arrow and is shaped so as to urge fluid in an upward direction as shown by the dotted arrow.

Figure 3A:
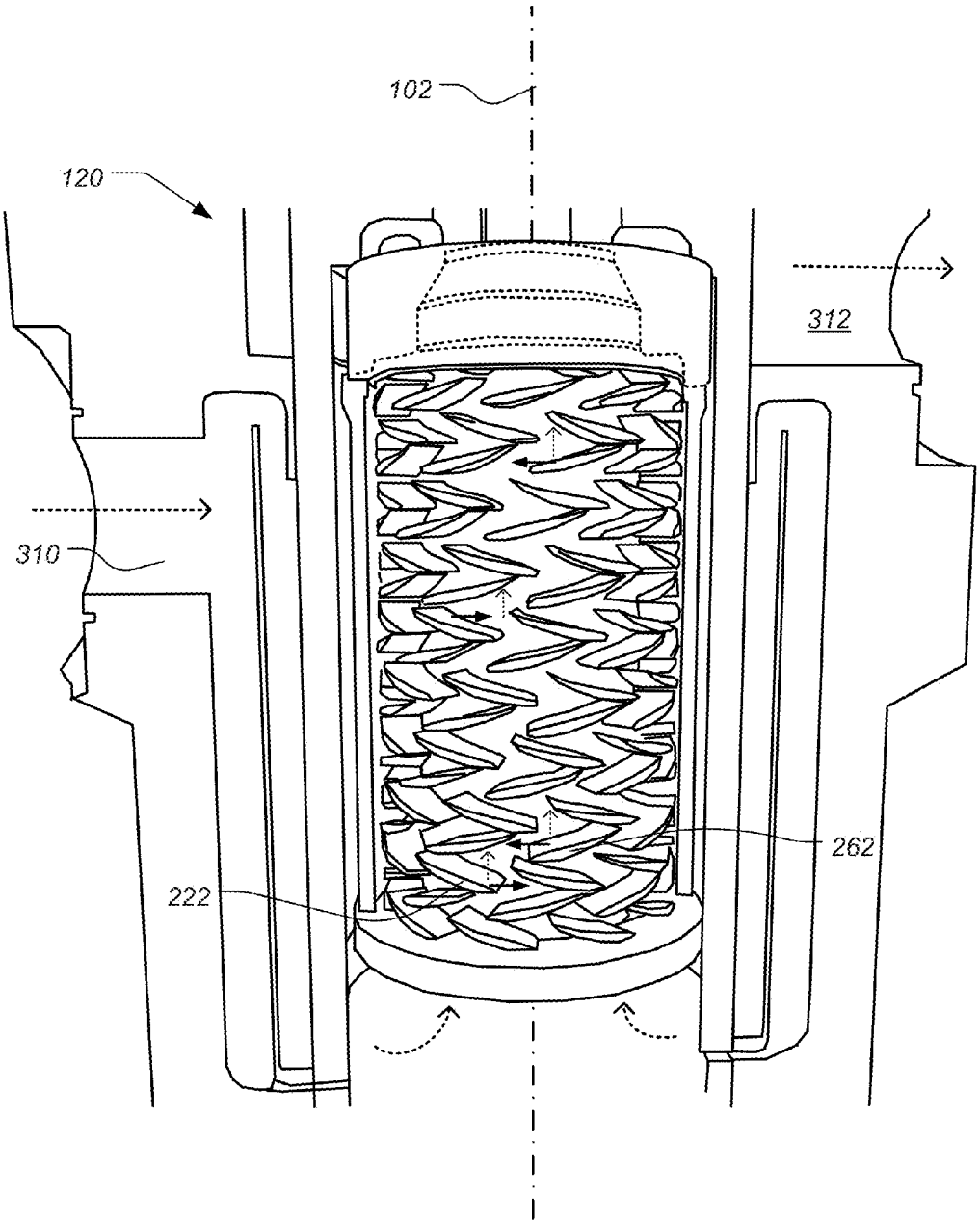
FIG. 3A is a perspective view of the compressor section 120, showing the interleaving of the rows of impellers mounted to the inner hub and outer sleeve, according to some embodiments.

FIG. 3A is a perspective view of the compressor section 120, showing the interleaving of the rows of impellers mounted to the inner hub and outer sleeve, according to some embodiments. The outer structure is shown in cut away for reasons of clarity. The fluid enters the compressor via inlet 310. The fluid then passes around and/or through a perforated wall and through a manifold such it enters the impeller section from the bottom. The alternating rows of impellers are driven in opposite directions and together urge the fluid upwards and in thus compressed to higher and higher pressures as it moves upwards. The compressed fluid exits the compressor section 120 via outlet 312. Two example impellers 222 and 262, that are also shown FIGS. 2A and 2B respectively, are shown in FIG. 3B with solid arrows indicting their respective directions of movement and dotted arrows shown the upwards urging of the fluid.

Figure 3B:
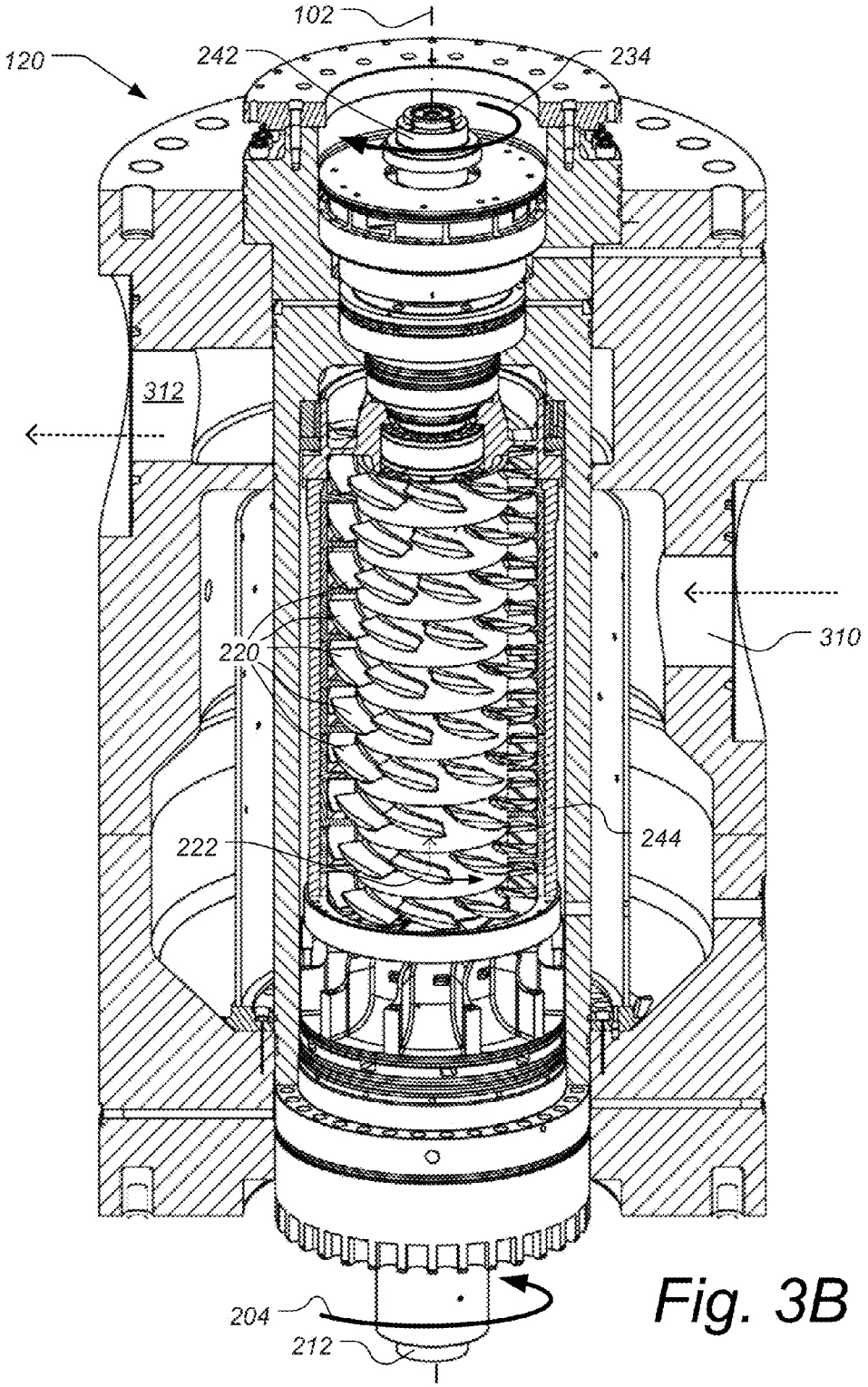
FIGS. 3B-3C are perspective cut away views of compressor section 120, showing further details of the rows of impellers and other structures, according some embodiments.
Figure 3C:
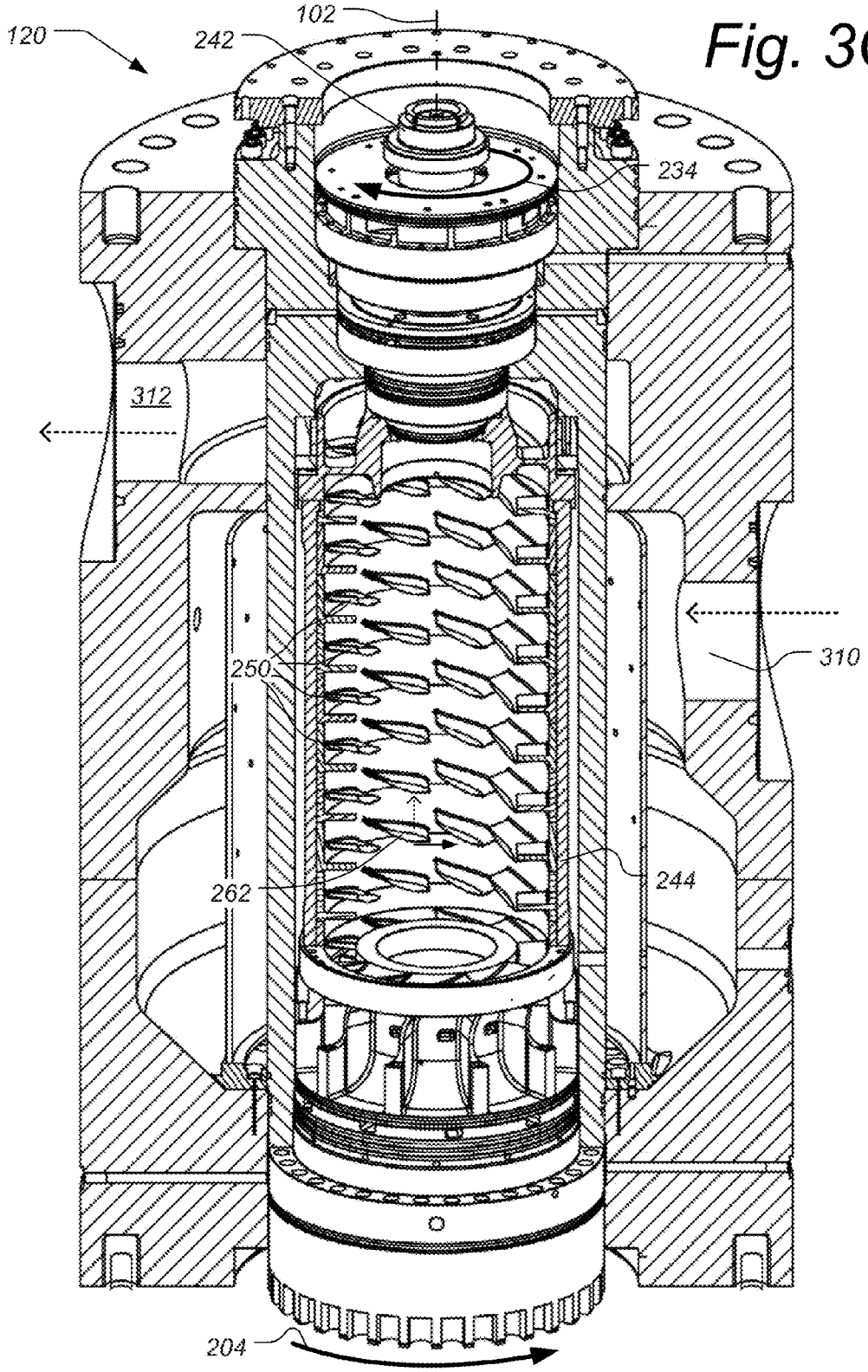

FIGS. 3B-3C are perspective cut away views of compressor section 120, showing further details of the rows of impellers and other structures, according some embodiments. In FIG. 3B, the fluid enters the compressor via inlet 310. The fluid then passes around and/or through a perforated wall and through a manifold such it enters the impeller section from the bottom. The alternating rows of impellers are driven in opposite directions and together urge the fluid upwards and in thus compressed to higher and higher pressures as it moves upwards. The compressed fluid exits the compressor section 120 via outlet 312. Also visible in FIG. 3B is lower shaft 212 that rotates about the central axis 102 in the direction shown by solid arrow 204, impellers 220 mounted on the inner hub as shown in distinct rows. Also visible is example impeller 222 that is being driven in the direction shown by the solid arrow and is shaped so as to urge fluid in an upwards direction shown by the dotted arrow. Outer sleeve 244 is also shown which is driven by upper shaft 242 in the direction shown by solid arrow 234.

In FIG. 3C, the upper shaft 242 is shown that rotates about the central axis 102 in the direction shown by solid arrow 234. Also visible are impellers 250 mounted on the outer sleeve 244 as shown in distinct rows. Also visible is example impeller 262 that is being driven in the direction shown by the solid arrow and is shaped so as to urge fluid in an upwards direction shown by the dotted arrow.

Figure 4:
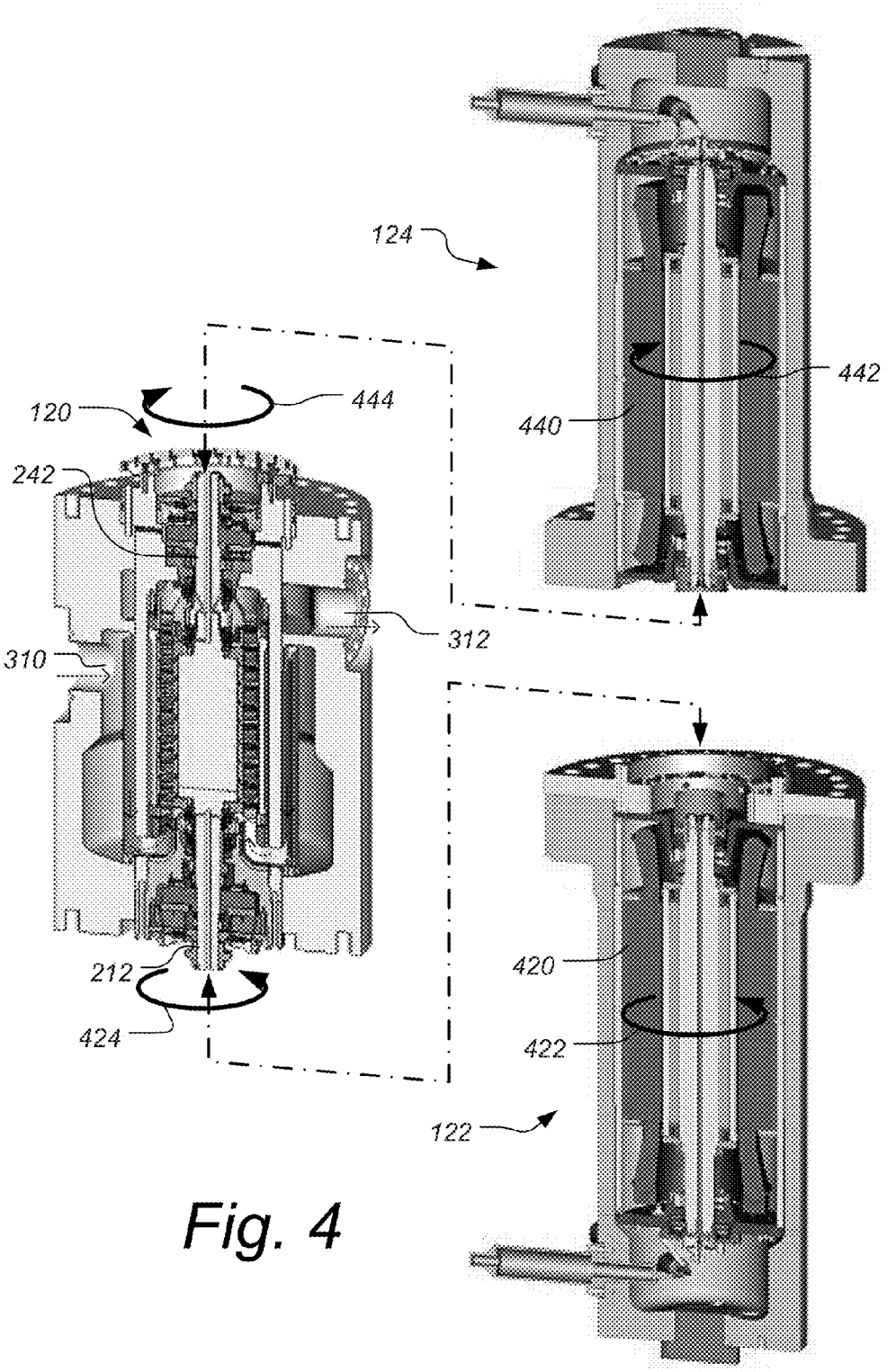
FIG. 4 is a cross-section perspective view of the lower motor, compressor and upper motor assemblies of a wet gas compressor, according to some embodiments.

FIG. 4 is a cross-section perspective view of the lower motor, compressor and upper motor assemblies of a wet gas compressor, according to some embodiments. The lower motor 122 includes an electric motor unit 420 that applies a rotational force in the direction of arrow 422 to lower shaft 212, causing the lower shaft 212 to rotate in the direction shown by direction arrow 424. Similarly, The upper motor 124 includes an electric motor unit 440 that applies a rotational force in the direction of arrow 442 to upper shaft 242, causing the upper shaft 242 to rotate in the direction shown by direction arrow 444.

Figure 5A:
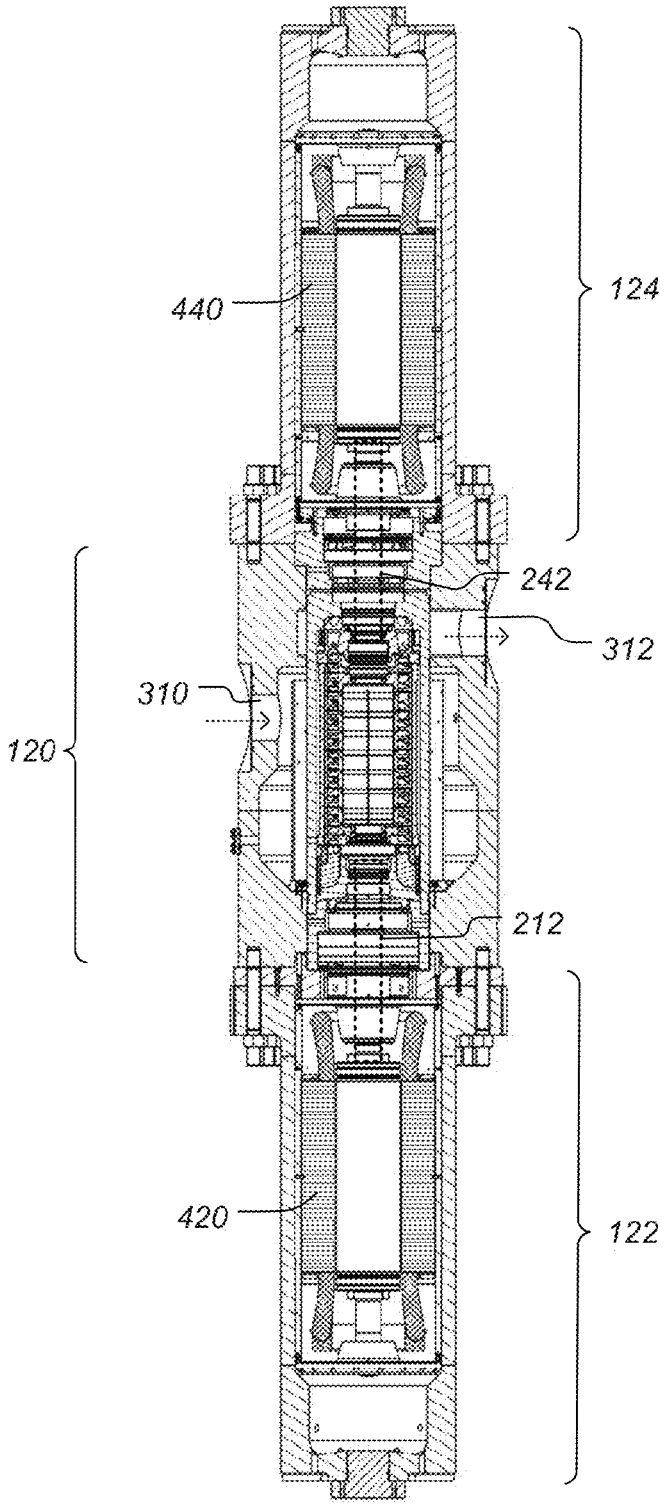
FIGS. 5A and 5B are cross-sectional views showing further details of the lower motor, compressor and upper motor assemblies of a wet gas compressor, according to some embodiments.
Figure 5B:
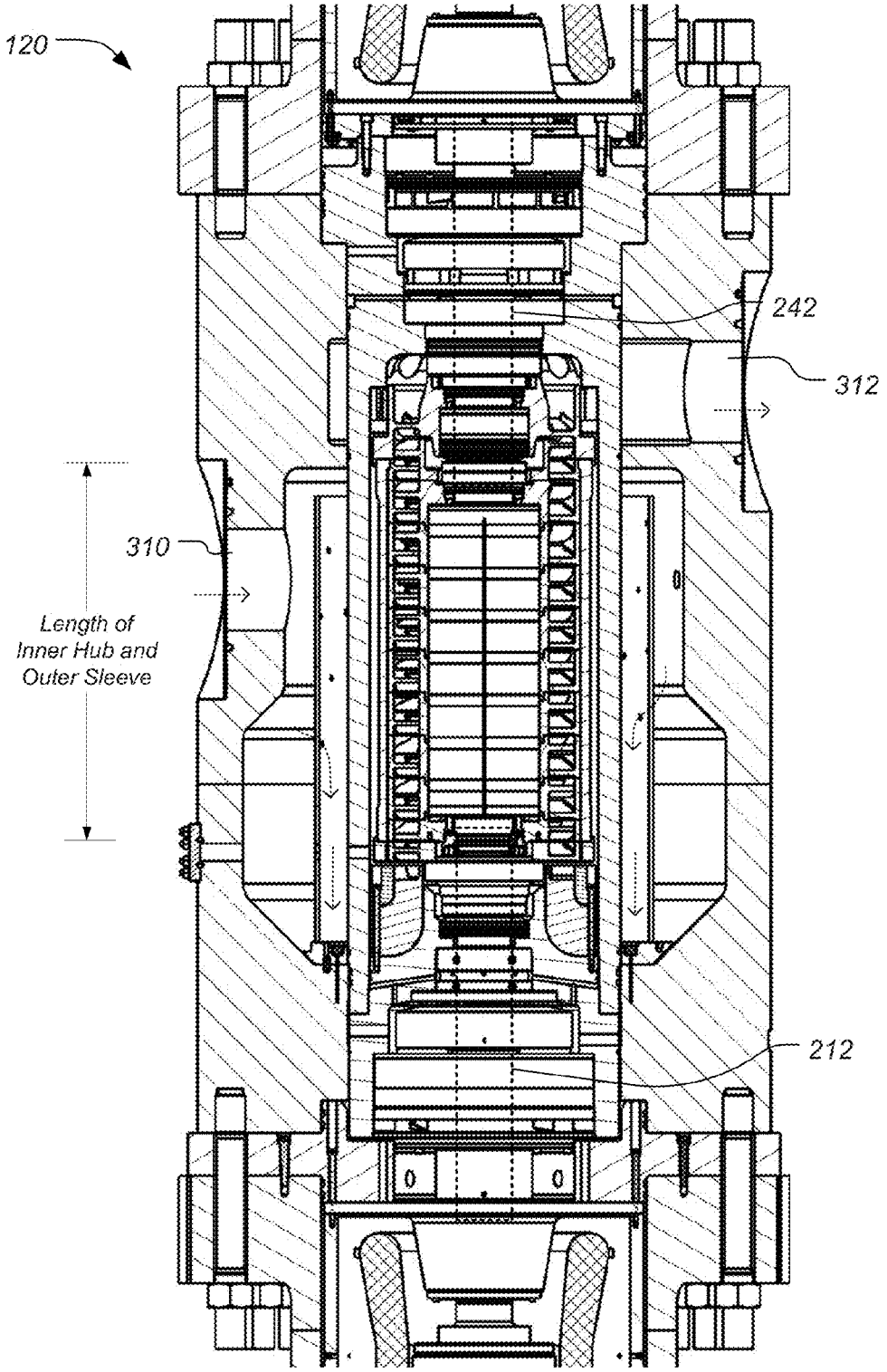

FIGS. 5A and 5B are cross-sectional views showing further details of the lower motor, compressor and upper motor assemblies of a wet gas compressor, according to some embodiments. FIG. 5A shows the compressor section 120 attached to the lower motor 122 and upper motor 124. FIG. 5B shows further detail of the compressor section 120.

As can be seen, the interleaved rows of impellers mounted to the inner hub and outer sleeve are stacked successively to each other and rotate in opposite directions. In this way, each row of impellers forms a separate stage of the compressor. Note that in this design there are no guide vanes or diffusers between the successive adjacent stages. Rather, the fluid discharged from a stage rotating in one direction immediately enters into the stage rotating in the opposite direction and so on through a number of successive contra rotating stages.

By introducing successive contra rotating impeller blade stages in this way, guide vanes and diffusers can be omitted. An interesting aspect of this design is that the lengths of the inner hub and the outer sleeve that transfer the rotational energy to the impellers from lower motor 122 and upper motor 124, respectively, can be significantly reduced. By reducing these lengths over other designs, the number of stages provided can be reduced for the same energy input, allowing the required energy input or number of stages to be fit on a short stiff shaft. Furthermore, by shaping and arranging the impeller blades so as to directly impart axial motion (parallel to the rotating central axis) to the process fluid, the impeller blades can be mounted directly to the inner hub and outer sleeve, thereby eliminating the need for additional cross member structures such as disks or arms that extend from the hub and/or sleeve. By eliminating additional structures and mounting the impeller blades directly on the hub and/or sleeve, the design is even more mechanically robust when compared to other designs. The compressor shown with relatively short dimensions of the inner hub and outer sleeve members, as well as mounting the impeller blades directly on those members, has been found to be significantly less prone to any unbalance due to uneven load distribution which can result from the presence of separated liquid and gas phases in the process stream.

In an example wherein the gas and liquid phases enters the compressor as a homogeneous mixture, the contra rotating impeller blade stages has been found to provide effective inter-stage mixing. And since diffusers or guide vanes are not present, the gas and liquid fluids remains in a well mixed homogeneous state throughout all the compressor stages.

When the process gas and liquid are in a well-mixed homogeneous state, the process fluid can be considered as "single-phase" with equivalent fluid properties.

$$Ro=GVF*RoG+(1-GVF)*RoL$$

$$Cp=GMF*CpG+(1-GMF)*CpL$$

In particular, the equivalent mixture density will increase significantly with increasing liquid content. The increased density will translate a given head into an increased pressure ratio.

$$P2/P1=(Ro1*g*H/(f'n/(n-1)*P1)+1)\hat{}(n/(n-1))$$

Also, the equivalent mixture heat capacity will increase significantly with increasing liquid content. The increased heat capacity will reduce the temperature rise for a given pressure ratio and efficiency.

$$T2-T1=T1*((P2/P1)\hat{}((Z*R)/(Cp*\mathrm{Eff}))-1)$$

This inter-cooling effect will also contribute to an increased density that again results in a further increase in the pressure ratio.

Thus, the contra rotating impeller blade arrangement shown is: (1) structurally more robust by allowing for shorter effective shafts lengths (i.e. the inner hub and outer sleeve lengths) for applying energy to the impeller blades; (2) enhances for inter-stage mixing of gas and liquid phases; and (3) omits guide vanes and diffusers which allows for the gas liquid stream to remain well mixed and homogenised throughout all the compressor stages. It has been found that the arrangement shown provides for phase mixing so well, that the process fluid can be considered as "single-phase" with equivalent fluid properties. Accordingly, the presence of liquid in the process fluid will have an enhanced density effect that will increase the pressure ratio and an enhanced heat capacity effect that will reduce the temperature rise and further increase the pressure ratio.

Another significant advantage of the contra rotating design shown is that it is more compact, in width and length than many other designs. In particular, by mounting the impeller blades directly on the inner hub and outer sleeve structures, intermediate structures between the impeller blades and the hub and sleeve can be eliminated, thus leading to a reduced overall width of the compressor. Further, the contra rotating design allows for the use of two smaller motors instead of one larger motor, which has been found to further reduce the unit's dimensions. An important aspect of the physical compactness of the design is its ability to be deployed using certain types of deployment techniques. In particular, for subsea deployment and retrieval, the use of an open moon-pool vessel is a significant advantage, since larger compressor designs may have to be deployed using floating cranes and/or barges.

Figure 6:
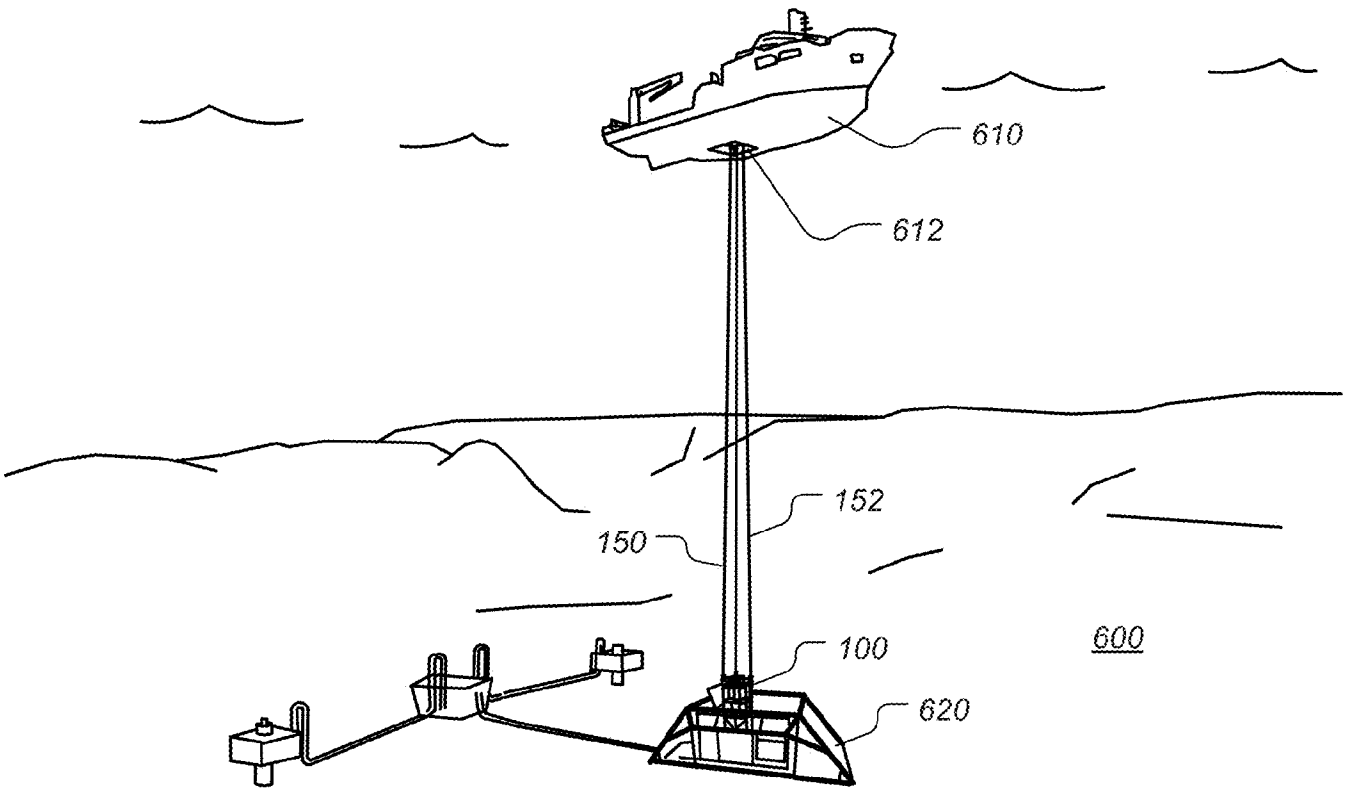
FIG. 6 illustrates aspects of a subsea deployment of a wet gas compressor, according to some embodiments.

FIG. 6 illustrates aspects of a subsea deployment of a wet gas compressor, according to some embodiments. Shown is subsea compressor module 100, such as shown and described herein, being deployed along guide cables 150 and 152 to seabed station 620. The compact format for compressor 100 makes it particularly well suited for the subsea market. The compressor 100 is designed to be deployed and or retrieved to/from the seabed 600 by a ship 610 with moon pool 612. Moon pool 612 is a penetration of the hull of ship 610 into the sea. Normally this penetration approximately in the middle of the ship 610, as the ship movement would be at the minimum in this location. The installation of compressor 100 through moon pool 612 is quite independent of the weather conditions, as there will not be large water movement in the moon pool 612. This is a very significant advantage, particularly in the parts of the ocean where there very often are challenging weather conditions. For example, there are significant oil- and gas resources in the arctic, which due to moving ice greatly benefits from the use of subsea equipment and deployment techniques based on moon pool ships.

While the subject disclosure is described through the above embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the subject disclosure should not be viewed as limited except by the scope and spirit of the appended claims.

What is claimed is:

1. A subsea deployable counter-rotating compressor for compressing a fluid comprising:

a fluid inlet;

a perforated structure downstream of the fluid inlet;

a manifold downstream of the perforated structure;

wherein the fluid inlet, the perforated structure, and the manifold are configured such that the fluid is to flow from the fluid inlet, both through and around the perforated structure, and into the manifold;

a first elongated member rotatable about a longitudinal axis and disposed downstream of the manifold;

a first plurality of impellers fixedly mounted to the first member and being shaped and arranged so as to exert force on the fluid in a direction primarily parallel to the longitudinal axis when the first member is rotated in a first rotational direction about the longitudinal axis;

a second elongated member rotatable about the longitudinal axis and disposed downstream of the manifold;

wherein the manifold is configured to distribute the fluid to the first elongate member and the second elongate member;

a second plurality of impellers fixedly mounted the second member such that the first plurality of impellers is interleaved with the second plurality of impellers, the second plurality of impellers being shaped and arranged so as to exert force on the fluid in the same direction as the first impellers when the second member is rotated in a second rotational direction about the longitudinal axis, the second rotational direction being an opposite rotational direction to the first rotational direction; and a motor system mechanically engaged to the first member so as to rotate the first member in the first rotational direction, and mechanically engaged to the second member so as to rotate the second member in the second rotational direction.

2. A compressor according to claim 1 wherein the first elongated member is a hub and second elongated member is a sleeve that surrounds at least a portion of the hub.

3. A compressor according to claim 2 wherein the first and second pluralities of impellers are arranged in a plurality of rows of first impellers and a plurality of rows of second impellers, respectively, the first and second rows of impellers being mounted on the hub and sleeve in an alternating pattern of rows with each row of impellers making up a stage of the compressor that counter rotates with respect to each adjacent stage.

4. A compressor according to claim 3 wherein the fluid passing through the compressor during operation includes gas and liquid phases that are substantially mixed by the counter rotation of the stages.

5. A compressor according to claim 4 wherein the gas and liquid phases are mixed such that they act as a single mixed phase in the compressor.

6. A compressor according to claim 3 wherein no static diffuser elements are positioned between the alternating rows of impellers.

7. A compressor according to claim 3 wherein the impellers are mounted directly to the hub and sleeve without any intermediate structural members.

8. A compressor according to claim 1 wherein the motor system includes a first motor for rotating the first member in the first rotational direction and a second motor for rotating the second member in the second rotational direction.

9. A compressor according to claim 1 wherein the compressor is dimensioned such that it can be deployed from a moon pool of a ship.

10. A compressor according to claim 9 wherein the moon pool on the ship is an open moon pool.

11. A method for compressing a fluid including a gas phase and a liquid phase using a counter-rotating compressor on a sea floor, the method comprising:

routing a fluid through a fluid inlet;

routing the fluid through and around a perforated structure after routing the fluid through the fluid inlet;

distributing the fluid to a first elongated member and a second elongated member through a manifold after routing the fluid at least one of through and around the perforated structure;

rotating the first elongated member about a longitudinal axis in first rotational direction, the first elongated member having a plurality of first rows of impellers mounted thereon;

rotating the second elongated member about a longitudinal axis in a second rotational direction, the second rotational direction being an opposite rotational direction to the first rotational direction, the second elongated member having a plurality of second rows of impellers mounted thereon; and sucking the fluid successively and alternatingly through the first and second rows impellers, with each row of impellers exerting force on the fluid in a direction primarily parallel to the longitudinal axis.

12. A method according to claim 11 wherein the first elongated member is a hub and second elongated member is a sleeve that surrounds at least a portion of the hub.

13. A method according to claim 11 wherein the gas and liquid phases of the fluid are substantially mixed by the counter rotation of the stages.

14. A method according to claim 11 wherein no static diffuser elements are positioned between the rows of impellers.

15. A method according to claim 11 wherein the compressor is dimensioned such that it can be retrieved from the sea floor using an open moon pool of a ship.

16. A method for positioning a fluid compressor on a sea floor, the method comprising:

deploying a ship having a moon pool opening for installing subsea equipment to the sea floor; and lowering a compact turbo fluid compressor from the moon pool opening to the sea floor, the turbo fluid compressor being dimensioned so as to be deployable through the moon pool opening and being mechanically robust so as to reliably compress subsea fluids containing a mixture of gas and liquid phases;

wherein the fluid compressor comprises:

a fluid inlet;

a perforated structure downstream of the fluid inlet;

a manifold downstream of the perforated structure;

wherein the fluid inlet, the perforated structure, and the manifold are configured such that the fluid is to flow from the fluid inlet, both through and around the perforated structure, and into the manifold;

a first elongated member rotatable about a longitudinal axis, the first elongated member downstream of the manifold;

a first plurality of impellers fixedly mounted to the first member and being shaped and arranged so as to exert force on the fluid in a direction primarily parallel to the longitudinal axis when the first member is rotated in a first rotational direction about the longitudinal axis;

a second elongated member rotatable about the longitudinal axis, the second elongated member downstream of the manifold;

wherein the manifold is configured to distribute the fluid to the first elongate member and the second elongate member;

a second plurality of impellers fixedly mounted the second member such that the first plurality of impellers is interleaved with the second plurality of impellers, the second plurality of impellers being shaped and arranged so as to exert force on the fluid in the same direction as the first impellers when the second member is rotated in a second rotational direction about the longitudinal axis, the second rotational axis being an opposite rotational direction to the first rotational direction, and a motor system mechanically engaged to the first member so as to rotate the first member in the first rotational direction, and mechanically engaged to the second member so as to rotate the second member in the second rotational direction.

17. A method according to claim 16 wherein the first elongated member is a hub and second elongated member is a sleeve that surrounds at least a portion of the hub.

18. A method according to claim 17 wherein the first and second pluralities of impellers are arranged in a plurality of rows of first impellers and a plurality of rows of second impellers, respectively, the first and second rows of impellers being mounted on the hub and sleeve in an alternating pattern of rows with each row of impellers making up a stage of the compressor that counter rotates with respect to each adjacent stage.

19. A method according to claim 18 wherein the fluid passing through the compressor during operation includes gas and liquid phases that are substantially mixed by the counter rotation of the stages.

20. A method according to claim 18 wherein no static diffuser elements are positioned between the alternating row of impellers.

* * * * *